US010072528B2

(12) United States Patent
Nagao et al.

(10) Patent No.: US 10,072,528 B2
(45) Date of Patent: Sep. 11, 2018

(54) AXIAL-FLOW EXHAUST TURBINE

(71) Applicant: MITSUBISHI HITACHI POWER SYSTEMS, LTD., Kanagawa (JP)

(72) Inventors: Hideto Nagao, Tokyo (JP); Hirokazu Shirai, Tokyo (JP); Taichi Ozaki, Tokyo (JP); Yasuyuki Tatsumi, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 588 days.

(21) Appl. No.: 14/413,595

(22) PCT Filed: Apr. 17, 2013

(86) PCT No.: PCT/JP2013/061361

§ 371 (c)(1),
(2) Date: Jan. 8, 2015

(87) PCT Pub. No.: WO2014/010287

PCT Pub. Date: Jan. 16, 2014

(65) Prior Publication Data

US 2015/0176435 A1 Jun. 25, 2015

(30) Foreign Application Priority Data

Jul. 11, 2012 (JP) ..... 2012-155629

(51) Int. Cl.
*F01D 25/32* (2006.01)
*F01D 25/24* (2006.01)
*F01D 25/30* (2006.01)

(52) U.S. Cl.
CPC ..... *F01D 25/32* (2013.01); *F01D 25/24* (2013.01); *F01D 25/243* (2013.01);
(Continued)

(58) Field of Classification Search
CPC ..... F01D 25/32; F01D 25/30; F01D 25/24; F01D 25/243; F01D 25/246; F05D 2220/31; F05D 2260/602; F05D 2260/608
(Continued)

(56) References Cited

U.S. PATENT DOCUMENTS 3,861,827 A * 1/1975 Peabody ..... F01D 25/246 415/199.5
5,494,405 A * 2/1996 Gray ..... F01D 25/32 415/211.2

(Continued)

FOREIGN PATENT DOCUMENTS

CN 102168583 8/2011
DE 102 55 389 6/2004

(Continued)

OTHER PUBLICATIONS

English Machine Translation of JP 11-13415, Jan. 1999.*

(Continued)

*Primary Examiner* — Christopher Verdier
(74) *Attorney, Agent, or Firm* — Wenderoth, Lind & Ponack, L.L.P.

(57) ABSTRACT

An axial-flow exhaust turbine is capable of discharging water drops collected from a steam passage. The axial-flow exhaust turbine includes: a steam passage in which rotor blades and stator blades are arranged in rows; an exhaust chamber for discharging steam from the steam passage in a turbine axial direction, the exhaust chamber being positioned at a downstream side of the steam passage; a casing including the steam passage and the exhaust chamber inside the casing; an inner partition wall positioned on an inner circumferential side of the casing so as to face the exhaust chamber; and a drain flow channel defined between the casing and the inner partition wall. The water drops col- (Continued)

lected from the steam passage can pass through the drain flow channel.

3 Claims, 10 Drawing Sheets

(52) U.S. Cl.
CPC ..... *F01D 25/246* (2013.01); *F01D 25/30* (2013.01); *F05D 2220/31* (2013.01); *F05D 2260/602* (2013.01); *F05D 2260/608* (2013.01)

(58) Field of Classification Search
USPC .... 415/169.2–169.4, 126, 134, 209.2–209.4, 415/210.1, 213.1, 214.1
See application file for complete search history.

(56) References Cited

U.S. PATENT DOCUMENTS

| | | | |
|---|---|---|---|
| 2010/0296926 | A1 | 11/2010 | Arase et al. |
| 2012/0099967 | A1 | 4/2012 | Sakai et al. |

FOREIGN PATENT DOCUMENTS

| | | |
|---|---|---|
| EP | 0 418 887 | 3/1991 |
| JP | 59-22902 | 2/1984 |
| JP | 61-182403 | 8/1986 |
| JP | 2-12005 | 1/1990 |
| JP | 7-42506 | 2/1995 |
| JP | 7-279618 | 10/1995 |
| JP | 8-260905 | 10/1996 |
| JP | 8-260906 | 10/1996 |
| JP | 9-256808 | 9/1997 |
| JP | 10-18807 | 1/1998 |
| JP | 10-103009 | 4/1998 |
| JP | 11-13415 | 1/1999 |
| JP | 2000-54805 | 2/2000 |
| JP | 2000-80904 | 3/2000 |
| JP | 2003-314299 | 11/2003 |
| JP | 2004-162536 | 6/2004 |
| JP | 2004-211586 | 7/2004 |
| JP | 2005-113696 | 4/2005 |
| JP | 3815143 | 8/2006 |
| JP | 2007-332777 | 12/2007 |
| JP | 2011-89425 | 5/2011 |
| KR | 10-2010-0117088 | 11/2010 |
| SU | 775355 | 10/1980 |
| SU | 1321847 | 7/1987 |

OTHER PUBLICATIONS

English Machine Translation of JP 08-260906, Oct. 1996.*
Office Action dated Feb. 18, 2016 in corresponding Korean Patent Application No. 10-2015-7000392 (with English translation).
Notice of Allowance dated Feb. 3, 2016 in corresponding Chinese Application No. 201380035634.4 (with English Translation).
Office Action dated Jan. 12, 2016 in corresponding Japanese Application No. 2014-524670 (with English Translation).
First Office Action dated Jul. 3, 2015 in corresponding Chinese Application No. 201380035634.4 (with English translation).
International Preliminary Report on Patentability (with translation) dated Jan. 13, 2015 in corresponding International Application No. PCT/JP2013/061361.
International Search Report (with translation) dated Jul. 30, 2013 in corresponding International Application No. PCT/JP2013/061361.
Extended European Search Report dated Jul. 6, 2016 in corresponding European Application No. 13816226.8.
Decision to Grant a Patent dated Aug. 5, 2016 in corresponding Japanese Application No. 2014-524670 (with English translation).
Notice of Allowance dated Aug. 26, 2016 in corresponding Korean Application No. 10-2015-7000392 (with English translation).

* cited by examiner

AXIAL-FLOW EXHAUST TURBINE

TECHNICAL FIELD

The present invention relates to an axial-flow exhaust turbine in which steam having passed through a blade cascade is discharged in a turbine axial direction. It especially relates to an axial-flow exhaust turbine including a mechanism for discharging a drain from a steam passage in which the blade cascade is arranged.

BACKGROUND

In the low-pressure stage of the blade cascade in a steam turbine, performance degradation (moist loss) due to a drain (water drops) produced in moist steam and erosion due to a drain attack, which is a collision of the drain on a portion of a turbine, are seen as problems. Thus, there has been developed a steam turbine including a mechanism for discharging a drain in moist steam from a steam passage of a turbine. For instance, Japanese Unexamined Patent Application No. 7-42506 discloses a configuration in which a slit is disposed along the circumferential direction on an outer race that holds stator blades so that a drain in steam is discharged through the slit to the outside of a steam passage.

Here, in a downward exhaust turbine including a condenser disposed below a low-pressure chamber, steam having exited from the final-stage rotor blades of the low-pressure chamber is guided by a flow guide to flow downward, and then drawn into the condenser. Thus, when a drain is collected from a steam passage by a slit described in Japanese Unexamined Patent Application No. 7-42506, for instance, it is only required to provide a through hole for discharging drains on a blade base attached on a low-pressure turbine casing to cause the drain to be introduced into the condenser by the pressure difference between the outlet and inlet of the through hole.

Meanwhile, another known steam turbine of a condensing type is an axial-flow exhaust turbine that discharges steam having passed through a blade cascade in a turbine axial direction. The axial-flow exhaust turbine can restrict exhaust loss (pressure loss due to exhaust gas) low, which makes it possible to maintain high energy efficiency. The axial-flow exhaust turbine is also advantageous in terms of the layout because it is not necessary to dispose a condenser at a lower part of the turbine. In a common axial-flow exhaust turbine, an exhaust chamber is disposed on the outlet side of the blade cascade, i.e., on the downstream side in the turbine axial direction, of a casing. The casing surrounds the blade cascade in which a plurality of rotor blades and stator blades are arranged in rows. Normally, a condenser is disposed on the further downstream side of the exhaust chamber in the axial direction, communicating with the exhaust chamber.

In the above axial-flow exhaust turbine, the condenser is arranged adjacent to the exhaust chamber in the axial direction. Thus, discharging a drain from a steam passage may be a problem.

In regard to the above issue, Japanese Unexamined Patent Application No. 10-18807 discloses a configuration of a drain-discharging device employed in an axial-flow exhaust turbine. The drain-discharging device includes a drain hole disposed on a blade base on which the final-stage stator blades are supported, and a pocket communicating with the drain hole. The pocket and an exhaust chamber are in communication with each other through a plurality of piping. With this device, a drain in a steam passage is drawn in by the negative pressure in the exhaust chamber connected to the condenser to be introduced into the exhaust chamber through the drain hole, the pocket, and the plurality of piping. Then, the drain reaches the condenser with the exhaust gas.

Technical Problem

However, it is difficult to collect all of the drain from a steam passage in an axial-flow exhaust turbine even using the conventional drain collecting mechanism, and a part of the drain may remain in the steam passage of the exhaust chamber. Thus, erosion may be caused on the wall surface of the exhaust chamber positioned immediately downstream the final stage by collision of the drain. Since the exhaust chamber is normally formed as a single piece, it is necessary to replace the entire exhaust chamber when the exhaust chamber is damaged. Thus, maintenance works due to damage by erosion are extensive and also expensive.

Further, when the drain flow channel of the stator blades and the exhaust chamber are connected via piping as in Japanese Unexamined Patent Application No. 10-18807, the piping protrudes to the outside of the casing, which increases the size of the turbine as a whole. This requires a large building where a large room can be secured for disposing the turbine, which causes the cost to increase.

SUMMARY

In view of the above issues, an object of at least some embodiments of the present invention is to provide an axial-flow exhaust turbine that is capable of discharging a drain from a steam passage smoothly, reducing the maintenance cost upon occurrence of erosion, and saving space.

Solution to Problem

An axial-flow exhaust turbine according to one embodiment of the present invention includes: a steam passage in which rotor blades and stator blades are arranged in rows; an exhaust chamber for discharging steam from the steam passage in a turbine axial direction disposed at a downstream side of the steam passage; a casing including the steam passage and the exhaust chamber inside the casing; an inner partition wall disposed on an inner circumferential side of the casing so as to face the exhaust chamber; and a drain flow channel which is formed between the casing and the inner partition wall and through which a drain collected from the steam passage is passable. The inner partition wall may be disposed over the entire exhaust chamber, or over a part of the exhaust chamber.

According to the above axial-flow exhaust turbine, since the inner partition wall facing the exhaust chamber is disposed on the inner circumferential side of the casing, the drain in the steam does not hit the inner wall surface of the casing, but hits the inner partition wall disposed inside the inner wall surface of the casing. Thus, damage due to erosion is limited to the inner partition wall, which makes it possible to prevent damage on the casing itself. As a result, it is no longer necessary to replace the whole casing upon maintenance and only the inner partition wall needs to be replaced, which facilitates maintenance works and also makes it possible to reduce the maintenance cost.

Further, since the space formed between the casing and the inner partition wall is used as the drain flow channel, it is possible to smoothly discharge the drain collected from the steam passage. Moreover, it is not necessary to dispose piping for introducing the drain on the outside of the casing, unlike Japanese Unexamined Patent Application No.

10-18807. Thus, it is possible to save space in the turbine and improve the flexibility of the layout.

In one embodiment, the axial-flow exhaust turbine may further include a plurality of supporting parts protruding from the casing toward the inner circumferential side. The inner partition wall may be supported on the casing via the plurality of supporting parts.

As described above, the inner partition wall is supported on the casing via the plurality of supporting parts protruding toward the inner circumferential side from the casing, which makes it possible to support the inner partition wall on the casing stably.

In one embodiment, the drain may pass between a pair of supporting rods to be introduced into the drain flow channel, the pair of supporting rods forming adjacent two of the supporting parts.

In this way, it is no longer necessary to provide an additional channel for introducing the drain collected from the steam passage to the drain flow channel, which makes it possible to simplify the apparatus configuration.

In one embodiment, the axial-flow exhaust turbine may further include a ring member protruding from the casing toward the inner circumferential side, the ring member including an opening through which the drain is passable. The inner partition wall may be supported on the casing via the ring member.

According to the above axial-flow exhaust turbine, the inner partition wall is supported on the entire periphery in the circumferential direction with respect to the casing via the ring member, which makes it possible to fix the inner partition wall on the casing even more stably. Further, the ring member includes an opening through which the drain is passable, which makes it possible to smoothly introduce the drain collected from the above passage to the drain flow channel.

In one embodiment, one of a member on a casing side and a member on an inner partition wall side may include a fitting groove having a stepped portion in the turbine axial direction, and other one of the member on the casing side and the member on the inner partition wall side may include a protruding portion configured to be fitted into the fitting groove, the fitting groove and the protruding portion being fitted to each other.

In the above axial-flow exhaust turbine, the fitting groove disposed on one of the member on the casing side and the member on the inner partition wall side is fitted with a protruding portion disposed on the other. The fitting groove here includes a stepped portion in the turbine axial direction. Thus, it is possible to prevent movement of the inner partition wall in the turbine axial direction relative to the casing by fitting the fitting groove and the protruding portion with each other.

In one embodiment, the casing may be dividable at a horizontal dividing plane so as to include an upper-half casing and a lower-half casing. The inner partition wall may be dividable at the horizontal dividing plane so as to include an upper-half partition wall and a lower-half partition wall. Also, a first key and a second key may be fitted into a first key slot and a second key slot at the horizontal dividing plane, respectively. The first key slot is formed over a member on an upper-half casing side and the upper-half partition wall, while the second key slot is formed over a member on a lower-half casing side and the lower-half partition wall.

According to the above axial-flow exhaust turbine, the first key slot formed over the member on the upper-half casing side and the upper-half partition wall and the second key slot formed over the member on the lower-half casing side and the lower-half partition wall are provided, and the first key and the second key are fitted into the above first key slot and the second key slot, respectively, which makes it possible to prevent movement of the upper-half partition wall and the lower-half partition wall in the circumferential direction.

In one embodiment, the first key is fastened to the member on the upper-half casing side so that the first key supports a load of the upper-half partition wall.

In this way, the upper-half partition wall is supported by the member on the upper-half casing side via the first key, which makes it possible to prevent the upper-half partition wall from falling.

In one embodiment, the first key slot may include an upstream first key slot and a downstream first key slot. The upstream first key slot may be disposed over the upper-half partition wall and the member on the upper-half casing side at an upstream side, and the downstream first key slot may be disposed over the upper-half partition wall and the member on the upper-half casing side at a downstream side, so that an upstream first key and a downstream first key are fitted into the upstream first key slot and the downstream first key slot, respectively.

Also, the second key slot may include an upstream second key slot and a downstream second key slot. The upstream second key slot may be disposed over the lower-half partition wall and the member on the lower-half casing side at an upstream side, and the downstream second key slot may be disposed over the lower-half partition wall and the member on the lower-half casing side at a downstream side, so that an upstream second key and a downstream second key are fitted into the upstream second key slot and the downstream second key slot, respectively.

In this way, the inner partition wall is fixed to the casing more securely, which enables stable operation of the turbine for a long period of time.

In one embodiment, the inner partition wall may be divided into two or more segments at least along a plane perpendicular to the turbine axial direction. For instance, the inner partition wall may be halved at a plane perpendicular to the turbine axial direction.

In this way, replacement of a segment that is more likely to be damaged such as the inner partition wall at the upstream side is facilitated.

In one embodiment, an upstream inner partition wall, from among the segments of the inner partition wall, disposed on an upstream side may be mounted attachably and detachably to a first supporting structure from a downstream side in the turbine axial direction.

In this way, when a supporting member is required upon attachment of the upstream inner partition wall to the casing side, it is unnecessary to dispose the supporting member in the exhaust chamber. As a result, turbulence of the steam flow may not be caused in the exhaust chamber.

In one embodiment, a downstream inner partition wall, from among the segments of the inner partition wall, disposed on a downstream side of the steam passage with respect to the upstream inner partition wall may be supported on the casing via a second supporting structure protruding toward the inner circumferential side from the casing.

In this way, it is possible to attach or detach the downstream inner partition wall with respect to the casing separately from the upstream inner partition wall, which facilitates maintenance.

In one embodiment, the upstream inner partition wall may include a positioning member including two members having an eccentric structure.

In this way, positioning the upstream inner partition wall with respect to the casing is facilitated. Thus, an accurate circularity of the upstream inner partition wall is obtained, which facilitates adjustment of the clearance between the inner partition wall and the rotor blades.

In one embodiment, the second supporting structure may include an adjusting plate which is capable of determining a position of the downstream inner partition wall with respect to a radial direction.

In this way, it is possible to adjust the position in the radial direction of the downstream inner partition wall with respect to the casing, which makes it possible to reduce the turbulence of the steam flow in the exhaust chamber.

Advantageous Effects

According to at least one embodiment of the present invention, the inner partition wall facing the exhaust chamber is disposed on the inner circumferential side of the casing, which makes it possible to prevent damage due to erosion on the casing itself, and thus it is unnecessary to replace the whole casing upon maintenance. Moreover, since only the inner partition wall is required to be replaced, maintenance works are facilitated and it is possible to reduce the maintenance cost.

Further, since the space formed between the casing and the inner partition wall is used as the drain flow channel, it is possible to smoothly discharge the drain collected from the steam passage, and to save space in the turbine to improve the flexibility of the layout.

DETAILED DESCRIPTION

The first and the second embodiments of the present invention will now be described in detail with reference to the accompanying drawings. It is intended, however, that dimensions, materials, shapes, relative positions and the like of components described in the embodiments shall be interpreted as illustrative only and not limitative of the scope of the present invention.

Figure 1:
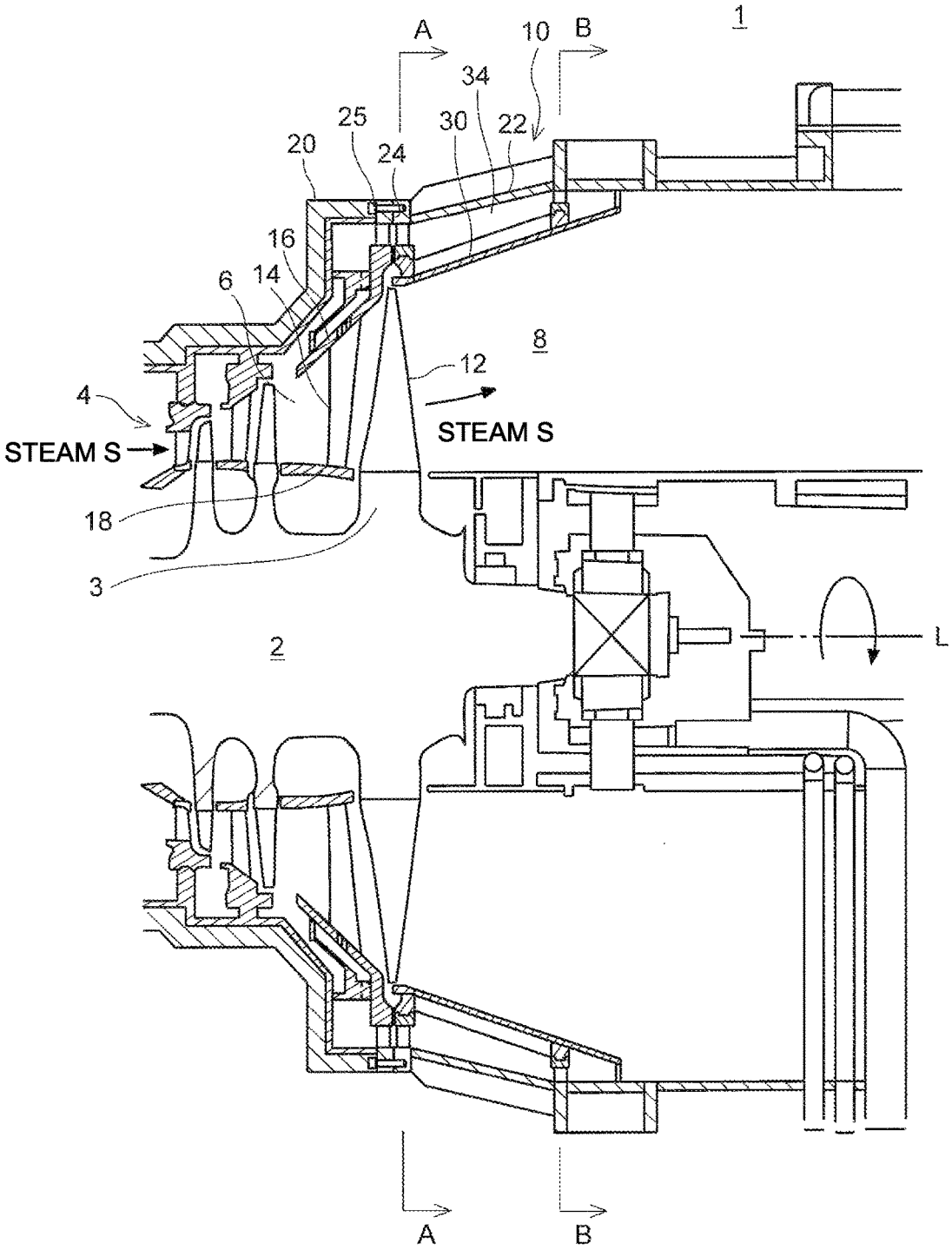
FIG. 1 is a cross-sectional view of an overall configuration of an axial-flow exhaust turbine according to the first embodiment.

Hereinafter, in a case where steam S flows from a rotor-blade side 12 toward an exhaust-chamber side 8, an upstream side means the rotor-blade side (the left side in FIG. 1) and a downstream side means the exhaust-chamber side (the right side in FIG. 1). Further, a turbine axial direction means a direction in which a turbine axis L in FIG. 1 is arranged, i.e., a direction in which the steam S flows from the upstream side to the downstream side of the exhaust chamber. A radial direction means a direction perpendicular to the turbine axial direction, and a circumferential direction means a direction rotating about the turbine axis L.

(First Embodiment)

Figure 2:
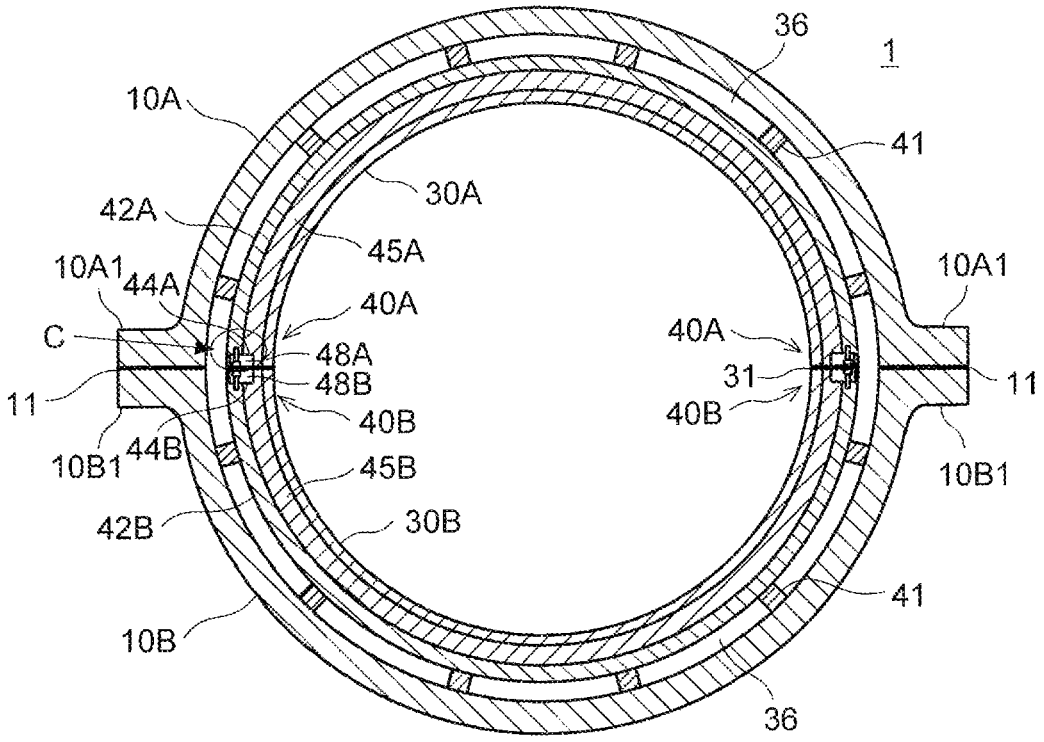
FIG. 2 is a cross-sectional view of the axial-flow turbine in FIG. 1, taken along line A-A.
Figure 3:
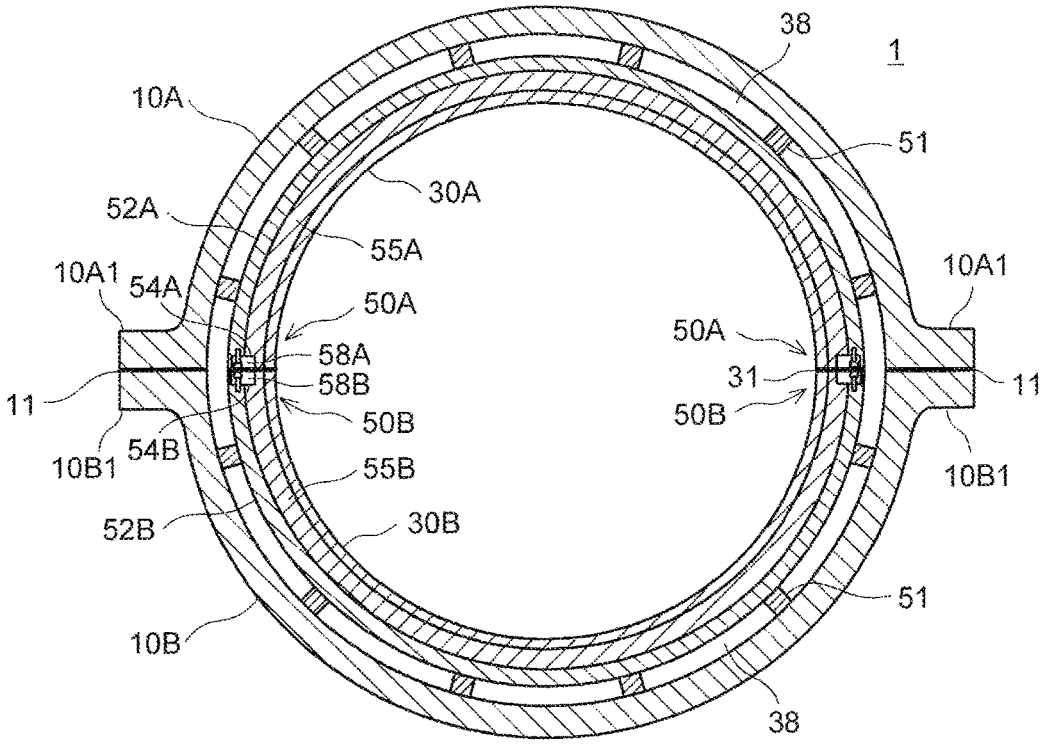
FIG. 3 is a cross-sectional view of the axial-flow turbine in FIG. 1, taken along line B-B.
Figure 4:
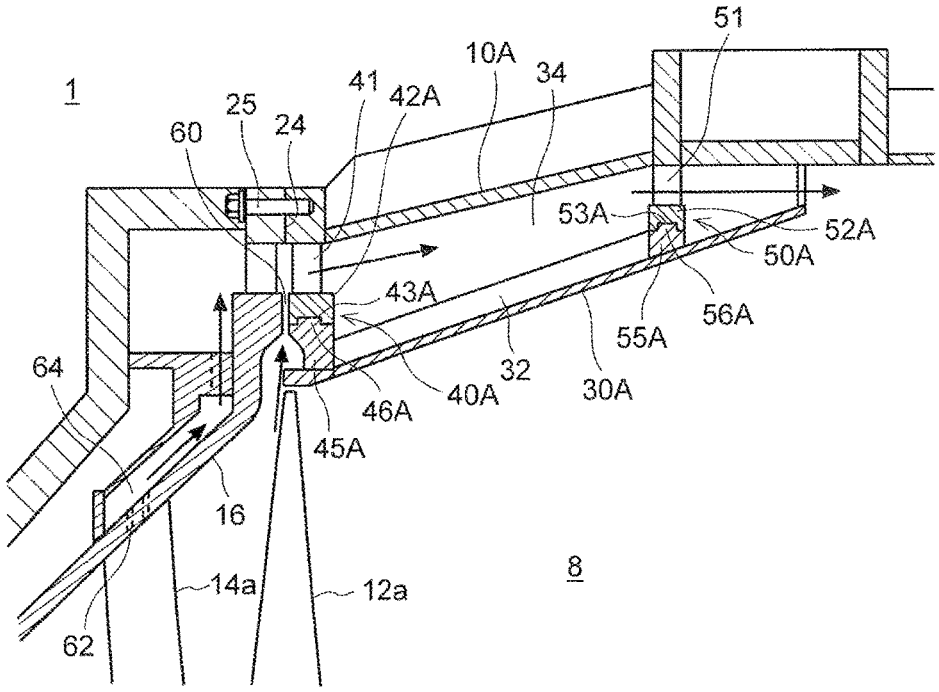
FIG. 4 is a partial cross-sectional view of an inner partition wall of the axial-flow exhaust turbine and a surrounding area according to the first embodiment.

FIG. 1 is a cross-sectional view of an overall configuration of an axial-flow exhaust turbine according to the first embodiment. FIG. 2 is a cross-sectional view of the axial-flow exhaust turbine in FIG. 1, taken along line A-A. FIG. 3 is a cross-sectional view of the axial-flow exhaust turbine in FIG. 1, taken along line B-B. FIG. 4 is a partial cross-sectional view of an inner partition wall of the axial-flow exhaust turbine and a surrounding area according to the first embodiment. FIG. 4 illustrates the same cross section (vertical cross section) as that in FIG. 1.

As illustrated in FIG. 1, an axial-flow exhaust turbine 1 includes a rotor 2, a blade cascade 4 arranged around the rotor 2, a steam passage 6 passing through the blade cascade 4, an exhaust chamber 8 disposed on the downstream side of the steam passage 6, and a casing 10 including the steam passage 6 and the exhaust chamber 8 inside the casing 10.

The rotor 2 is supported rotatably with respect to the casing 10. A plurality of rotor blades 12 are disposed on the outer circumferential surfaces of discs 3 of the rotor 2, while a plurality of stator blades 14 are arranged around the rotor 2 so as to face the plurality of rotor blades 12. The rotor blades 12 and the stator blades 14 thereby form a blade cascade 4. The plurality of rotor blades 12 is disposed outwardly in a radial fashion from the outer circumferential surfaces of the discs 3, and mounted in a plurality of stages at intervals in the turbine axial direction L. The plurality of stator blades 14 is arranged in a radial fashion while having both ends supported on the casing 10 by an outer shroud 16 (also referred to as a blade-root ring) and an inner shroud 18, and mounted in a plurality of stages at intervals in the turbine axial direction L. Further, a space passing through the blade cascade 4, i.e., a space across which the plurality of rotor blades 12 and the plurality of stator blades 14 face each other, serves as a steam passage 6 through which steam S flows in the direction of the arrow in FIG. 1.

The exhaust chamber 8 is disposed on the downstream side of the steam passage 6 and serves as a space for discharging the steam S from the steam passage 6 in the turbine axial direction L. On the downstream side in the turbine axial direction L of the exhaust chamber 8, a condenser (not illustrated) is disposed so that steam S having passed the exhaust chamber 8 is introduced into the condenser. The condenser is normally maintained to have a negative pressure by being vacuumed.

The casing 10 is disposed so as to form the steam passage 6 and the exhaust chamber 8. In the example illustrated in FIG. 2, the casing 10 is divided into an upper section and a lower section at a horizontal dividing plane 11 to include an upper-half casing 10A and a lower-half casing 10B which are fastened to each other via flanges 10A1, 10B1 to form a substantially sealed space. In FIGS. 2 and 3, the components inside the turbine such as the blade cascade 4 and the rotor 2 are omitted.

Further, in the casing 10, at least one of the upper-half casing 10A and the lower-half casing 10B may include a portion forming the exhaust chamber 8 and being separated from other portions at a plane perpendicular to the turbine axial direction L. In one embodiment, FIGS. 1 and 4 illustrate a configuration in which the casing 10 has a shape such that the diameter increases toward the downstream side in the turbine axial direction L, and at least the upper-half casing 10A is divided in the turbine axial direction L. In this configuration, the casing 10 is divided into the first casing 20 forming the steam passage 6 and the second casing 22 forming the exhaust chamber 8, at a vertical dividing plane 24 perpendicular to the turbine axial direction L. The end surfaces of the first casing 20 and the second casing 22 on the vertical dividing plane 24 side are butted to each other, and the first casing 20 and the second casing 22 are fastened to each other via bolts 25. The casing 10 may be further divided at a downstream side with respect to the dividing plane 24 in the turbine axial direction L, into the second casing 22 forming the exhaust chamber 8 and the third casing (not illustrated) on the condenser side. In this way, the upper-half casing 10A of the second casing 22 is detachable, which makes it possible to easily access the inside of the casing for the purpose of maintenance or the like. Alternately, portion of the casing 10 forming the steam passage 6 and the exhaust chamber 8 may be configured as a single piece.

In the axial-flow exhaust turbine 1 having the above configuration, the steam S introduced into the steam passage 6 expands and the speed increases when passing through the steam passage 6. Next, the steam S rotates the rotor 2 and then enters the exhaust chamber 8. When passing through the steam passage 6, the temperature and pressure of the steam S decrease so that the steam S becomes moist to turn into steam, and thereby a drain is produced. As a result, there is a possibility of damage due to erosion on a turbine portion such as the rotor blades 12 of a low-pressure stage of the blade cascade or a wall surface on the inlet side of the exhaust chamber 8. Thus, in the present embodiment, a drain discharging mechanism described below is provided for the purpose of discharging a drain and preventing damage due to erosion.

As illustrated in FIGS. 1 to 4, the axial-flow exhaust turbine 1 further includes an inner partition wall 30 (30A, 30B) disposed on the inner circumferential side of the casing 10 (10A, 10B) so as to face the exhaust chamber 8 and a drain flow channel 34 formed between the casing 10 and the inner partition wall 30.

In one embodiment, the inner partition wall 30 is disposed over the outlet side of the blade cascade 4, i.e., the vicinity of the final-stage rotor blades 12*a* and the exhaust chamber 8. At this time, the inner partition wall 30 may be disposed over the exhaust chamber 8 entirely or partially. However, in a case where the inner partition wall 30 is disposed partially over the exhaust chamber 8, it is desirable to provide the partition wall 30 at least on the inlet side of the exhaust chamber 8 so that the partition wall 30 also functions as the drain flow channel 34. The inner partition wall 30 may also have a shape such that the diameter increases toward the downstream side in the turbine axial direction L. Here, a plurality of ribs 32 may be disposed on the outer circumferential surface of the inner partition wall 30 in the circumferential direction for the purpose of reinforcement of the inner partition wall 30, the ribs 32 being formed in the turbine axial direction L.

A drain (water drops) collected in the steam passage 6 is introduced into the drain flow channel 34. The steam passage 6 may include a steam collecting part which collects the steam in the passage 6 and directs the steam to the drain flow channel 34. FIG. 4 illustrates an example of the drain collecting part. In this example, a slit 60 is provided as the steam collecting part at the outer circumferential side of the steam inflow end of the final-stage rotor blades 12*a*. The drain accumulated on the inner wall of the outer shroud 16 flows downstream due to the steam flow so as to be discharged to the outside of the steam passage 6 through the slit 60 and then introduced into the drain flow channel 34 communicating with the slit 60. Further, a drain hole 62 may be disposed as the steam collecting part in the outer shroud 16 of the final-stage stator blades 14*a*. A drain produced in the vicinity of the final-stage blade cascade passes through the drain hole 62 to be introduced into an annular channel 64 formed on the outer side of the hole 62, and then introduced into the drain flow channel 34 communicating to the annular channel 64 through the annular channel 64. Then, the drain having been introduced into the drain flow channel 34 from the steam collecting part passes through the drain flow channel 34 to be discharged to the downstream side of the exhaust chamber 8.

According to the present embodiment, since the inner partition wall 30 facing the exhaust chamber 8 is disposed on the inner circumferential side of the casing 10, it is possible to prevent damage due to erosion on the casing 10 itself, which makes it unnecessary to replace the whole casing 10 upon maintenance. Further, only the inner partition wall 30 needs to be replaced, which facilitates the maintenance work and thus enables reduction of the maintenance cost.

Furthermore, since the space formed between the casing 10 and the inner partition wall 30 is used as the drain flow channel 34, it is possible to smoothly discharge the drain collected from the steam passage 6, and also to save space in the turbine, which makes it possible to improve flexibility of the layout.

Figure 5:
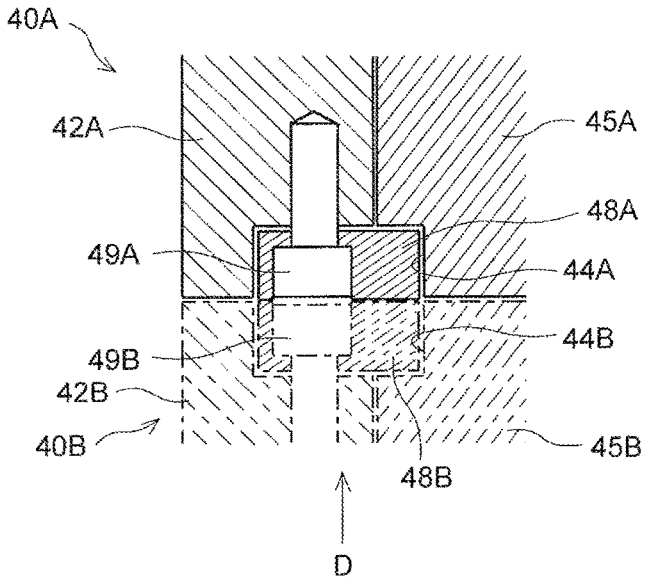
FIG. 5 is an enlarged view of part C in FIG. 2 illustrating an upstream supporting structure of the axial-flow exhaust turbine according to the first embodiment.
Figure 6:
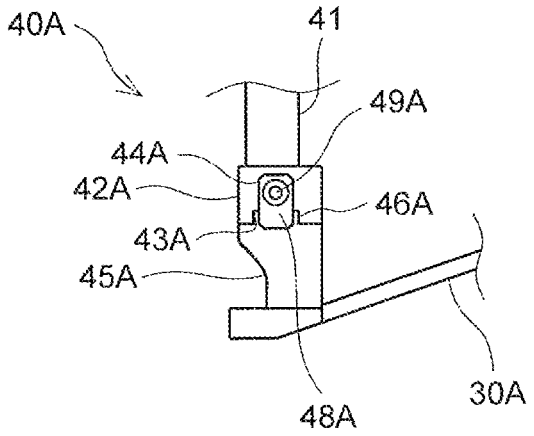
FIG. 6 is a view of the upstream supporting structure in FIG. 5 seen from direction D.
Figure 7:
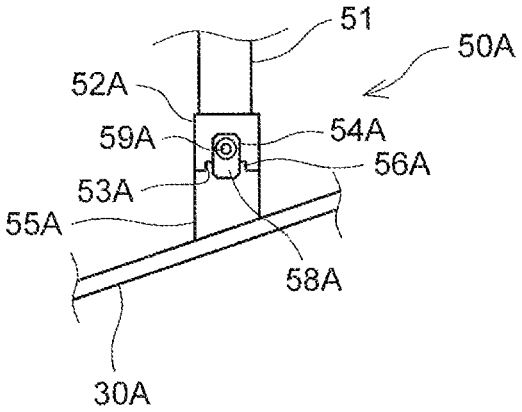
FIG. 7 is a view of a downstream supporting structure corresponding to the upstream supporting structure in FIG. 6.

A supporting structure of the inner partition wall 30 will be described in detail in reference to FIGS. 2 to 7. FIG. 5 is an enlarged view of part C in FIG. 2 illustrating an upstream supporting structure of the axial-flow exhaust turbine. FIG. 6 is a view of the upstream supporting structure in FIG. 5 seen from direction D. FIG. 7 is a view of a downstream supporting structure corresponding to the upstream supporting structure in FIG. 6.

The axial-flow exhaust turbine 1 according to the present embodiment may further include an upstream supporting structure 40 (40A, 40B) and a downstream supporting structure 50 (50A, 50B) which support the inner partition wall 30 on the casing 10 side. The upstream supporting structure 40 is disposed on the upstream side in the turbine axial direction L, and the downstream supporting structure 50 is disposed on the downstream side with respect to the upstream supporting structure 40.

In the present embodiment illustrated in FIG. 2, the upstream supporting structure 40 (40A, 40B) includes a plurality of supporting rods 41 which protrude from the casing 10 (10A, 10B) toward the inner circumferential side, so that the inner partition wall 30 (30A, 30B) is supported on the casing 10 via the supporting rods 41 constituting a plurality of supporting parts. The supporting rods 41 are arranged in a radial fashion between the casing 10 and the inner partition wall 30. A clearance 36 may be provided between two adjacent supporting rods 41 so as to allow the drain to pass through.

In the present embodiment illustrated in FIG. 3, the downstream supporting structure 50 (50A, 50B) includes a plurality of supporting rods 51 which protrudes from the casing 10 (10A, 10B) toward the inner circumferential side, so that the inner partition wall 30 (30A, 30B) is supported on the casing 10 via the supporting rods 51. The supporting rods 51 are arranged in a radial fashion between the casing 10 and the inner partition wall 30. A clearance 38 may be provided between two adjacent supporting rods 51 so as to allow the drain to pass through.

The above configuration makes it no longer necessary to provide an additional channel for directing the drain collected from the steam passage 6 to the drain flow channel 34. Thus, it is possible to simplify the apparatus configuration.

Further, as illustrated in FIGS. 1 to 3, the inner partition wall 30 may be supported with respect to the casing 10 attachably and detachably. An embodiment of the axial-flow exhaust turbine 1 having the attachable and detachable inner partition wall 30 includes the following configuration in particular.

As described above, the casing 10 is divided into the upper-half casing 10A and the lower-half casing 10B at the horizontal dividing plane 11. The inner partition wall 30 is similarly divided into an upper-half partition wall 30A and a lower-half partition wall 30B at the horizontal dividing plane 31.

Only the upper-half casing 10A and the upper-half partition wall 30A illustrated in FIGS. 2 to 6 will be described in detail to simplify the description.

As illustrated in FIGS. 2 and 4, the upstream supporting structure 40A includes a casing-side supporting member 42A attached to the ends of the supporting rods 41 on the partition wall side. The casing-side supporting member 42A has a semi-annular shape corresponding to the upper-half casing 10A. On the other hand, a partition-wall-side supporting member 45A is attached to the outer circumferential side of the upper-half partition wall 30A. The partition-wall-side supporting member 45A has a semi-annular shape corresponding to the upper-half partition wall 30A. As illustrated in FIGS. 5 and 6, an upstream first key slot 44A is formed over the casing-side supporting member 42A and the partition-wall-side supporting member 45A. An upstream first key 48A is fitted into the upstream first key slot 44A to be fastened to the casing-side supporting member 42A via a bolt 49A. In this way, the upper-half partition wall 30A is supported on the upper-half casing 10A. The portion indicated by the dotted chain line in FIG. 5 represents an upstream supporting structure 40B of the lower half.

As illustrated in FIGS. 3 and 4, the downstream supporting structure 50A includes a casing-side supporting member 52A attached to the ends of the supporting rods 51 on the partition wall side. The casing-side supporting member 52A has a semi-annular shape corresponding to the upper-half casing 10A. On the other hand, a partition-wall-side supporting member 55A is attached to the outer circumferential side of the upper-half partition wall 30A. The partition-wall-side supporting member 55A has a semi-annular shape corresponding to the upper-half partition wall 30A. As illustrated in FIG. 7 and similarly to the upstream supporting structure 40A, the first key slot 54A is formed over the casing-side supporting member 52A and the partition-wall-side supporting member 55A. A downstream first key 58A is fitted into the downstream first key slot 54A. Further, the downstream first key 58A is fastened to the casing-side supporting member 52A via a bolt 59A so that the upper-half partition wall 30A is supported on the upper-half casing 10A. On the upper-half section, the first keys 48A, 58A also support the load of the upper-half partition wall 30A.

As illustrated in FIG. 2 and similarly to the above described upper-half section, the upstream supporting structure 40B of the lower-half section also includes an upstream second key slot 44B formed over a casing-side supporting member 42B and a partition-wall-side supporting member 45B. An upstream second key 48B is fitted into the upstream second key slot 44B. Further, the upstream second key 48B is fastened to the casing-side supporting member 42B by a bolt 49B (see FIG. 5), so that the lower-half partition wall 30B is supported on the lower-half casing 10B.

Further, as illustrated in FIG. 3 and similarly to the above described upper-half section, the downstream supporting structure 50B of the lower-half section also includes a downstream second key slot 54B formed over a casing-side supporting member 52B and a partition-wall-side supporting member 55B. A downstream second key 58B is fitted into the downstream second key slot 54B. Further, the downstream second key 58B is fastened to the casing-side supporting member 52B by a bolt 59B, so that the lower-half partition wall 30B is supported on the lower-half casing 10B.

According to the above configuration, it is possible to easily detach the upper-half partition wall 30A and the lower-half partition wall 30B from the upper-half casing 10A and the lower-half casing 10B, respectively, by separating the upper-half casing 10A and the lower-half casing 10B from each other and removing the first keys 48A, 58A from the first key slots 44A, 54A as well as removing the second keys 48B, 58B from the second key slots 44B, 54B. Further, it is possible to easily mount the upper-half partition wall 30A and the lower-half partition wall 30B to the upper-half casing 10A and the lower-half casing 10B, respectively, by fitting the first keys 48A, 58A and the second keys 48B, 58B into the first key slots 44A, 54A and the second key slots 44B, 54B to be fastened thereto by bolts, respectively, while the upper-half casing 10A and the lower-half casing 10B are separated, and then fastening the upper-half casing 10A and the lower-half casing 10B to each other via bolts.

Further, according to the above axial-flow exhaust turbine 1, the first keys 48A, 58A and the second keys 48B, 58B are fitted into the first key slots 44A, 54A and the second key slots 44B, 54B, which makes it possible to prevent movement of the upper-half partition wall 30A and the lower-half partition wall 30B in the circumferential direction.

Furthermore, at the upstream and downstream sides in the turbine axial direction L, the first key slots 44A, 54A and the second key slots 44B, 54B as well as the first keys 48A, 58A and the second keys 48B, 58B are used to support the upper-half partition wall 30A and the lower-half partition wall 30B on the upper-half casing 10A and the lower-half casing 10B. Thus, the casing is more securely fixed to the inner partition wall, which enables stable operation of the turbine for a long period of time.

In addition, as illustrated in FIG. 4, the upstream supporting structure 40A may include a fitting groove 43A that has a stepped portion in the turbine axial direction L disposed on the casing-side supporting member 42A of the upper-half section and a protruding portion 46A that is to be fitted into the fitting groove 43A and disposed on the partition-wall-side supporting member 45A of the upper-half section. The fitting groove 43A and the protruding portion 46A are fitted to each other. The fitting groove 43A and the protruding portion 46A are each formed in a semi-annular shape, for instance.

Similarly, the upstream supporting structure 40B of the lower-half section may include a fitting groove 53A and a protruding portion 56A disposed on the casing-side supporting member 42B and the partition-wall-side supporting member 45B, respectively. The downstream supporting structures 50A, 50B at the downstream side in the turbine axial direction L may also have a similar configuration.

As described above, fitting the protruding portions 46A, 56A with the fitting grooves 43A, 53A makes it possible to prevent relative movement of the inner partition wall 30 with respect to the casing 10 in the turbine axial direction L.

(Second Embodiment)

Next, an axial-flow exhaust turbine including an inner partition wall varied from the first embodiment will be described below as the second embodiment. The present embodiment has a similar configuration to that of the first embodiment except for the inner partition wall.

Figure 8:
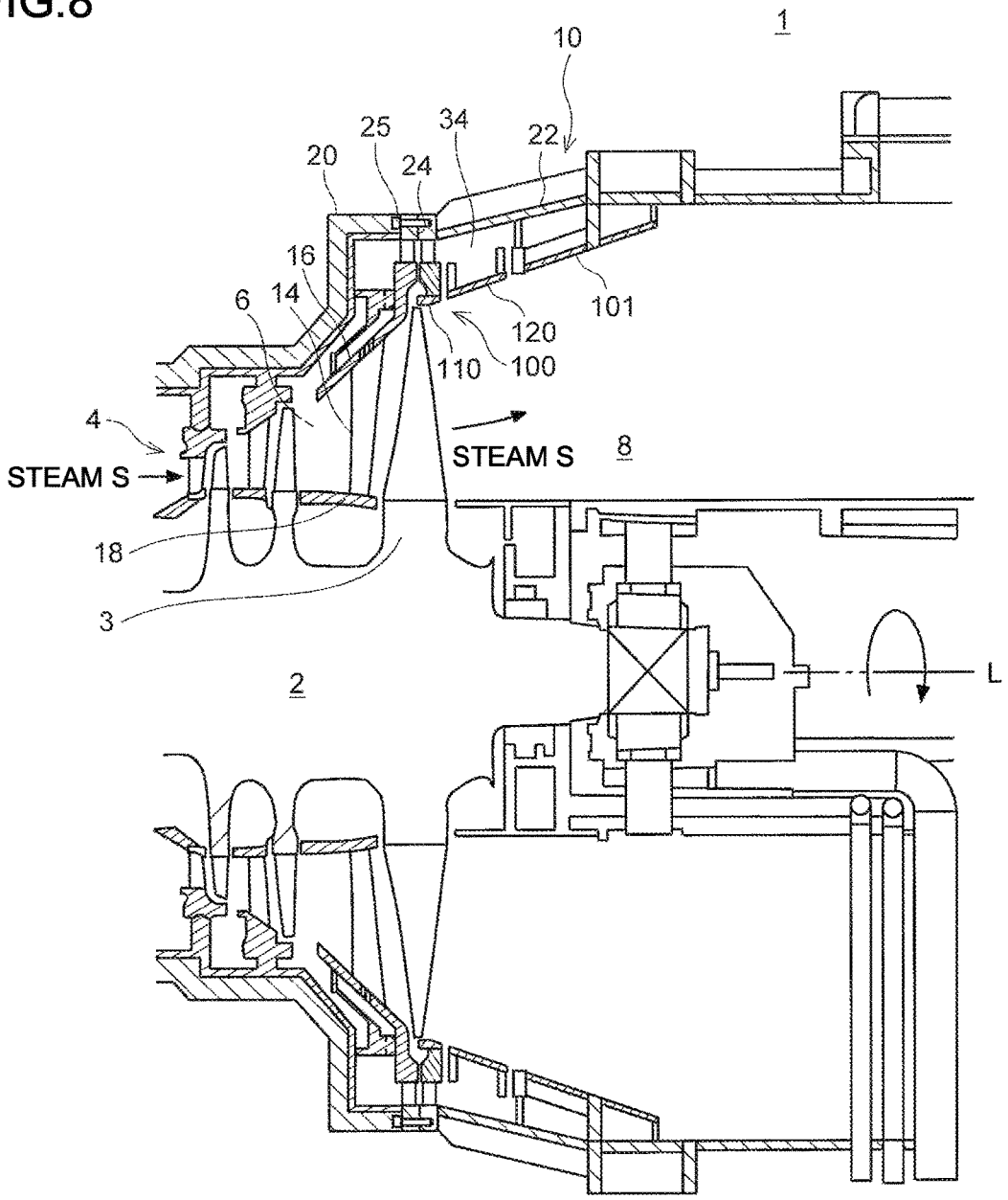
FIG. 8 is a cross-sectional view of an overall configuration of an axial-flow exhaust turbine according to the second embodiment.
Figure 9:
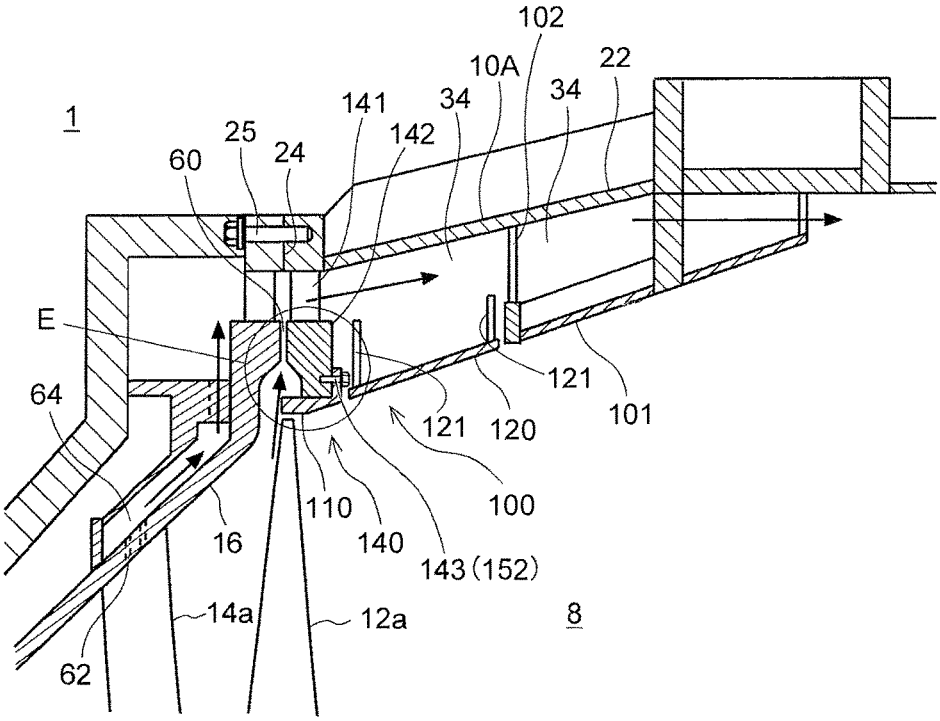
FIG. 9 is a partial cross-sectional view of an inner partition wall of the axial-flow exhaust turbine and a surrounding area according to the second embodiment.
Figure 10:
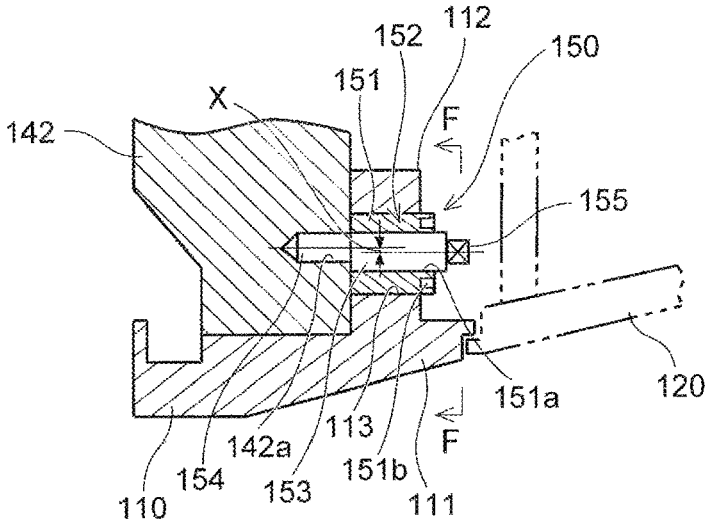
FIG. 10 is an enlarged view of part E illustrating a positioning structure of the upstream inner partition wall of FIG. 9.
Figure 11:
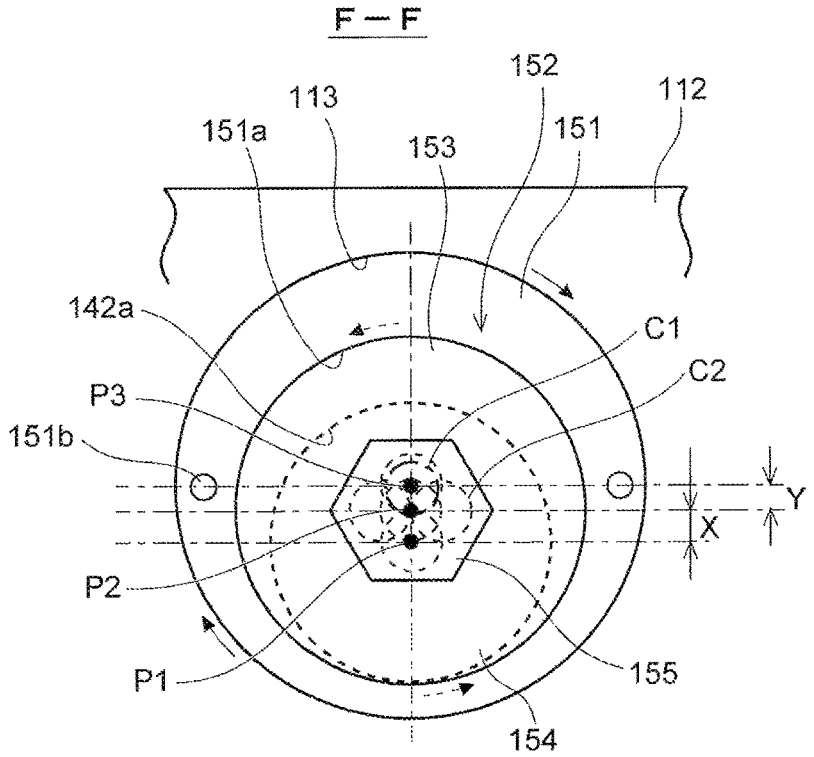
FIG. 11 is a cross-sectional view of FIG. 10 taken along line F-F.

FIG. 8 is a cross-sectional view of an overall configuration of an axial-flow exhaust turbine according to the second embodiment. FIG. 9 is a partial cross-sectional view of an inner partition wall of the axial-flow exhaust turbine and a surrounding area according to the second embodiment. FIG. 10 is an enlarged view of part E illustrating a positioning structure for the upstream inner partition wall of FIG. 9. FIG. 11 is a cross-sectional view of FIG. 10 taken along line F-F.

The same structures, components or the like as those of the first embodiment are indicated by the same names and reference signs to omit detailed descriptions. In the present embodiment, the casing 10 is also divided into the upper-half casing 10A and the lower-half casing 10B at the horizontal dividing plane 11 as described above, similarly to the first embodiment. Thus, reference signs indicating the configurations and components described below will be differentiated by adding "A" after the numeral for the upper-half casing, and "B" for the lower-half casing. When neither of the above is added and a numeral alone is used in the description, the description is related to the upper-half casing and it may be considered that the lower-half casing has the same configuration.

In FIGS. 8 and 9, the present embodiment is different from the first embodiment in that an inner partition wall 100 is divided into two segments (an upstream inner partition wall 110 and a downstream inner partition wall 120) at a plane perpendicular to the axial direction. That is, the inner partition wall 100 includes the upstream inner partition wall 110 disposed on the inlet side of the exhaust chamber 8 and the downstream inner partition wall 120 disposed on the immediate downstream side of the upstream inner partition wall 110. An attack of a steam drain discharged from the steam passage 6 mainly damages the inlet part of the exhaust chamber 8, which is the upstream inner partition wall 110 around a partition-wall-side supporting member 142. On the other hand, portions on the downstream side with respect to the partition-wall-side supporting member 142 are almost undamaged. Thus, the inlet part of the exhaust chamber 8 is made of a corrosion-resistant material which resists erosion or the like, and configured to be attachable and detachable. That is, the inner partition wall 100 at the inlet part of the exhaust chamber 8 is divided in half at a plane perpendicular to the axial direction so as to include the upstream inner partition wall 110 disposed on the inlet side of the exhaust chamber 8 and the downstream inner partition wall 120 disposed on the immediate downstream side of the upstream inner partition wall 110. The upstream and downstream inner partition walls 110, 120 are both attachable and detachable. The upstream inner partition wall 110 likely to be damaged by a drain attack is formed of a corrosion-resistant material. The downstream inner partition wall 120 on the downstream side of the upstream inner partition wall 110 is formed of a common steel iron material because the damage is little. The inner partition wall 100 is divided in the upstream inner partition wall 110 and the downstream inner partition wall 120 and configured to be attachable and detachable for the purpose of facilitating replacement of the upstream inner partition wall 110. The upstream inner partition wall 110 is replaced in a maintenance work and the downstream inner partition wall 120 can be used continuously without replacement.

Further, the downstream inner partition wall 120 disposed at the downstream side of the upstream inner partition wall 110 is disposed in an annular fashion around the turbine axis L. Reinforcement plates 121 are disposed in an annular fashion in the circumferential direction on the upstream end portion and the downstream end portion of the outer circumferential surface on the radially outer side of the downstream inner partition wall 120 to enhance rigidity of the downstream inner partition wall 120.

Furthermore, at the downstream side of the downstream inner partition wall 120, an inner casing 101 forming a part of the casing is fixed to the inner wall of the casing 10A by welding or the like via supporting rods 102, similarly to the structure described in the first embodiment. The inner casing 101 is disposed on the inner side in the radial direction of the second casing 22 (the casing 10A) so as to form a part of the exhaust chamber 8 around the turbine axis L. The annular gap surrounded by the second casing 22 and the inner casing 101 is in communication with the drain flow channel 34 formed in an annular shape and surrounded by the second casing 22 at the upstream side and the inner partition wall 100. The annular gap forms a part of the drain flow channel to serve as a channel for discharging the drain collected in the steam passage 6 to the downstream side of the exhaust chamber 8.

Next, the supporting structure of the upstream inner partition wall 110 will be described. As illustrated in FIG. 9, the upstream inner partition wall 110 is supported on the casing 10A via an upstream supporting structure 140 (the first supporting structure) fixed on the inner side of the casing 10A. The upstream supporting structure 140 includes supporting rods 141 and an inner-partition-wall side supporting member 142 disposed on the inner side of the supporting rods 141 in an annular fashion around the turbine axis L, similarly to the first embodiment. The upstream inner partition wall 110 is an annular member having an L-shaped cross section as seen in the circumferential direction, and is divided at least in half in the circumferential direction at the horizontal dividing plane 31. The upstream inner partition wall 110 is in contact with the inner circumferential surface on the radially inner side and the side surface at the downstream side of the partition-wall-side supporting member 142 to be fixed to the partition-wall-side supporting member 142 from the downstream side in the turbine axis L direction.

As illustrated in FIG. 10, the upstream inner partition wall 110 is a member including a guide portion 111 and a support portion 112 that are integrally formed. As seen in the circumferential direction, the guide portion 111 has an L-shaped cross section and faces the exhaust chamber 8 side, while the support portion 112 protrudes outwardly in the radial direction in a flange shape. The guide portion 111 is in contact with the inner circumferential surface of the partition-wall-side supporting member 142 at the outer circumferential surface in the radial direction. The support portion 112 is disposed on the downstream side of the guide portion 111 and is formed in an annular shape with respect to the axial direction to be erected outwardly from the guide portion 111 in the radial direction.

As illustrated in FIG. 9, the upstream inner partition wall 110 is screwed to the partition-wall-side supporting member 142 by bolts 143 from the downstream side in the turbine axis direction to be fixed thereto. Thus, bolt holes are opened on the support portion 112 of the upstream inner partition wall 110 so that the bolts 143 are insertable into the bolt holes. Also, female screws (not illustrated) are formed on the side surface at the downstream side of the partition-wall-side supporting member 142, the side surface contacting the support portion 112.

In this regard, it is desirable to mount the upstream inner partition wall 110, while maintaining the required circularity and adjusting a clearance from the rotor blades 12 to be constant. Thus, from among the bolts fixing the upstream inner partition wall 110, positioning members 150 for the inner partition wall having a positioning function are used to fix the upstream inner partition wall 110 instead of the bolts at more than one location (at least two for each divided segment of the upstream inner partition wall). The positioning members 150 for the inner partition wall will be described below.

The positioning members 150 for the inner partition wall determine the position in the circumferential direction of the upstream inner partition wall 110 with respect to the partition-wall-side supporting member 142 to maintain the circularity of the upstream inner partition wall 110 and adjust a clearance between the rotor blades 12 and the inner circumferential surface of the upstream inner partition wall 110.

As illustrated in FIG. 10, a plurality of through holes 113 is provided through the support portion 112 of the upstream inner partition wall 110 in the axial direction for the purpose of fixing the upstream inner partition wall 110 to the partition-wall side supporting member 142 from the downstream side in the axial direction. The positioning members 150 for the inner partition wall, or bushes 151 described below in particular, are insertable into the through holes 113. Further, a plurality of tip end holes 142*a* are provided through the side surface at the downstream side of the partition-wall-side supporting member 142 in the axial direction, the side surface contacting the support portion 112. The positioning members 150 for the inner partition wall, or tip end portions 152*b* of eccentric pins described below in particular, are fittable into the tip end holes 142*a*. The upstream inner partition wall 110 is fixed to the partition-wall side supporting member 142 from the downstream side in the axial direction by inserting the positioning members 150 for the inner partition wall into the through holes 113 of the support portion 112 and the tip end holes 142*a* of the partition-wall side supporting member 142 to be fitted therein.

As illustrated in FIGS. 10 and 11, each positioning member 150 for the inner partition wall includes a bush 151 and an eccentric pin 152. The bush 151 is a cylindrical member that includes a pin hole 151*a* into which the eccentric pin 152 is inserted. The eccentric pin 152 is a solid-cylindrical member that includes a body portion 153 having a large diameter and a tip end portion 154 having a diameter smaller than that of the body portion 153. A holding portion 155 that allows the eccentric pin 152 to rotate is disposed on the head of the eccentric pin 152. The pin hole 151*a* formed in the bush 151 has an inner diameter such that only the body portion of the eccentric pin 152 is insertable into the bush 151 to be fitted therein, and the tip end portion 154 of the eccentric pin 151 is inserted into the tip end hole 142*a* formed on the side surface at the downstream side of the partition-wall-side supporting member 142 to be fitted therein.

The eccentric pin 152 is formed so that the center P1 of the tip end portion 154 and the center P2 of the body portion 153 are eccentric in the radial direction of the eccentric pin 152 by a length X. The body portion 153 and the tip end portion 154 are integrally formed into a single eccentric pin 152. Further, it is desirable that the center of the holding portion 155 of the eccentric pin 152 coincides with the center P2 of the body portion 153. Similarly, the bush 151 is formed so that the center P2 of the pin hole 151*a* formed inside the bush 151 and the center P3 of the bush 151 are eccentric in the radial direction of the bush 151 by a length Y. At least two adjustment holes 151*b* are disposed on the outer surface of the bush 151 as seen from the downstream side in the turbine axial direction so that the bush is rotatable about the through hole.

Specifically, the center P2 of the pin hole 151*a* opened on the bush 151 is eccentric from the center P3 of the bush 151 by a length Y, while the center P2 of the body portion 153 and the center P1 of the tip end portion 154 of the eccentric pin 151 are eccentric with respect to each other by the length X. Further, since the body portion 153 of the eccentric pin 152 is fitted into the pin hole 151*a* of the bush 151, the center P2 of the body portion 153 of the eccentric pin 152 coincides with the center of the pin hole 151*a* of the bush 151. Combining the above components having an eccentric structure makes it possible to determine the position of the upstream inner partition wall 110 accurately with respect to the partition-wall-side supporting member 142.

That is, in the example illustrated in FIG. 11, the center P3 of the bush 151 and the center P1 of the tip end portion 154 of the eccentric pin 152 are eccentric with respect to each other by a length (X+Y). To maintain the circularity of the upstream inner partition wall 110, it is desirable to have a deviation (X+Y) of zero so that the center P1 and the center P3 coincide with each other.

As illustrated in FIG. 11, the bush 151 is a structure that is rotatable on the through hole 113 serving as a sliding surface with respect to the support portion 112. As a result of the rotation of the bush 151, the center P2 of the body portion 153 of the eccentric pin 152 moves along a circular track C1 (the circle of two-dotted chain line in FIG. 11) having a radius Y around the center P3 of the bush 151. Further, when the bush 151 is fixed and the eccentric pin 152 is rotated in the pin hole 151*a* of the bush 151 serving as a sliding surface around the center P2 of the body portion 153 of the eccentric pin 152, the center P1 of the tip end portion 154 of the eccentric pin 152 moves along a circular track C2

(the circle of dotted line in FIG. 11) having a radius X around the center P2 of the body portion 153.

That is, when the eccentric pin 152 is rotated around the center P2 of the body portion 153 with respect to the bush 151 while the bush 151 is rotated around the center P3 with respect to the support portion 112, the center P1 of the tip end portion 154 of the eccentric pin 152 moves within a circle having a radius (X+Y) around the center P3 of the bush 151.

Specifically, when the distance between the center (the center P3 of the bush 151) of the through hole 113 of the support portion 112 of the upstream inner partition wall 110 and the center (the center P1 of the tip end portion 154) of the tip end hole 142*a* of the partition-wall side supporting member 142 is in the range of the length (X+Y), it is possible to determine the position so that the deviation between the above distances (the gap between the center P1 and the center P3) becomes zero by combining two members having an eccentric structure. Here, the eccentric lengths X, Y of the bush 151 and the eccentric pin 152 may be selected in consideration of the manufacturing error of the partition-wall-side supporting member 142 and the upstream inner partition wall 110.

When the bush 151 and the eccentric pin 152 are operated separately from each other by the above movement, the position where the center P1 of the tip end portion 154 and the center P3 of the bush 151 coincide with each other is the accurate position of the upstream inner partition wall 110. After carrying out the position-determining movement for the plurality of positioning members 150 for the inner partition wall to determine the position of the upstream inner partition wall 110 with respect to the partition-wall side supporting member 142, other bolts 143 are used to mount the upstream inner partition wall 110 to the partition-wall-side supporting member 142 from the downstream side in the turbine axial direction, thereby completing adjustment of the clearance between the upstream inner partition wall 110 and the rotor blades 12. As described above, the upstream inner partition wall 110 is fixed with respect to the partition-wall supporting member 142 from the downstream side in the turbine axis direction by use of the supporting members such as the bolts 143 and the positioning members 150 for the inner partition wall. Thus, it is unnecessary to provide the above supporting members on the exhaust chamber side. As a result, turbulence may not be caused in the steam flow flowing in the exhaust chamber by the supporting members, and thus the turbine efficiency may not decrease.

Figure 12:
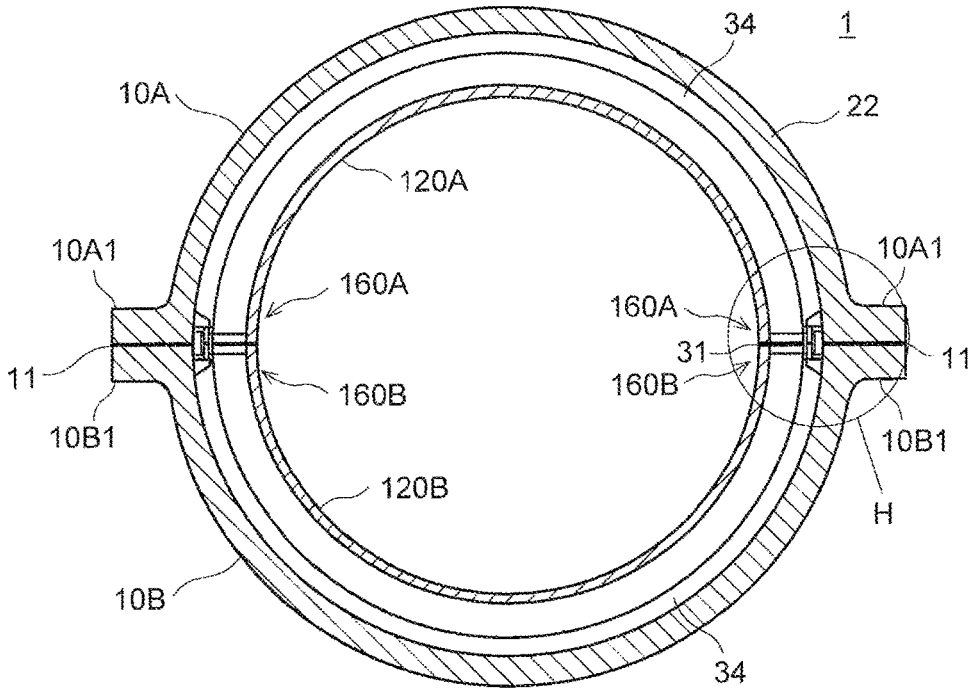
FIG. 12 is a cross-sectional view around the downstream supporting structure of the axial-flow exhaust turbine.
Figure 13:
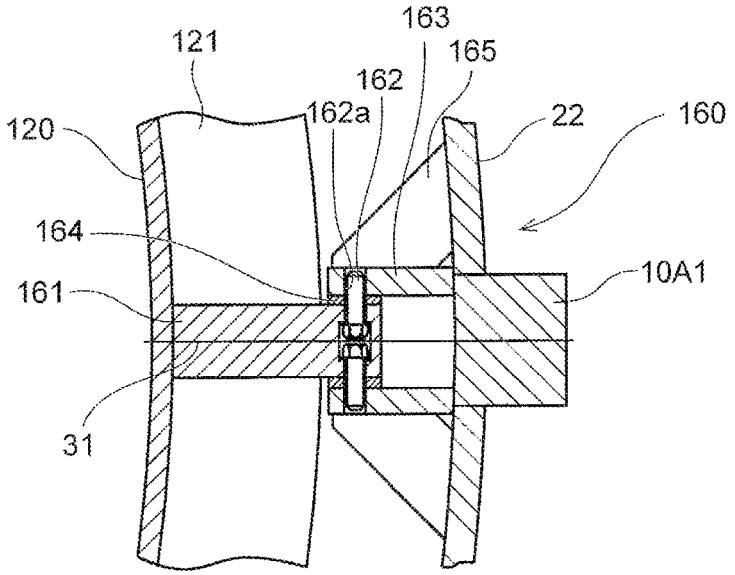
FIG. 13 is an enlarged view of part H of the axial-flow exhaust turbine in FIG. 12.

Next, a downstream supporting structure 160 (the second supporting structure) will be described in reference to FIGS. 12 and 13. The downstream inner partition wall 120 has a structure divided in half in the circumferential direction at the horizontal dividing plane 31 as described above. FIG. 13 is an enlarged view of part H from FIG. 12, illustrating a supporting structure between the downstream inner partition wall 120 and the casing 10. The downstream inner partition wall 120 includes a base plate 161 protruding outwardly in the radial direction on the outer wall of the downstream inner partition wall 120, and is fixed to the casing 10 via the downstream supporting structure 160. The base plate 161 is fixed to the outer side in the radial direction of the downstream inner partition wall 120 so as to be parallel to the horizontal dividing plane 31 at the same position as both ends in the circumferential direction of the upstream inner partition wall 120 which is divided in half. Bolt holes 162*a* are formed on the base plate 161. Bolts 162 for fixing the downstream inner partition wall 120 on the casing 10 side are insertable through the bolt holes 162*a*.

The downstream supporting structures 160 are mounted to the vicinity of the inner side in the radial direction of the second casing 22 of the upper-half casing 10A and the lower-half casing 10B at the vicinity of the horizontal dividing plane 31 of the casing 10. Each downstream supporting structure 160 includes a casing fixing plate 163 fixed to the second casing 22, the bolt 162 for fastening the base plate 161 to the casing fixing plate 163, and an adjusting plate 164 that is inserted between the base plate 161 and the casing fixing plate 163. The casing fixing plate 163 is a plate member fixed on the inner wall of the casing 22 and erected toward the turbine axis center from the inner wall in a direction parallel to the horizontal dividing plane 31. The casing fixing plate 163 includes bolt holes 162*a* having female screws into which the bolts 162 can be screwed. The adjusting plate 164 is inserted between the casing fixing plate 163 and the base plate 161 and capable of adjusting the position of the downstream inner partition wall 120 in the radial direction so that the inner circumferential surfaces of the upstream inner partition wall 110, the downstream inner partition wall 120, and the inner casing 101 become substantially flush to form a smooth surface. Selecting an adjusting plate having an appropriate thickness makes it possible to eliminate unevenness of the butting surface in the flowing direction of each inner circumferential surface to restrict turbulence in the flow of the steam S flowing in the exhaust chamber 8.

Further, while the casing divided into the upper-half casing 10A and the lower-half casing 10B is open, the inner partition wall is mounted to each of the casings. First, the accurate position of the upstream inner partition wall 110 with respect to the partition-wall supporting member 142 is determined using the positioning members 150 for the inner partition wall, and the upstream inner partition wall 110 is fixed to the partition-wall supporting member 142 with the eccentric pins 152. Next, the upstream inner partition wall 110 is fastened to the partition-wall-side supporting member 142 from the downstream side toward the upstream side in the axial direction with the bolts 143 to be mounted thereto. After mounting the upstream inner partition wall 110, the downstream inner partition wall 120 is mounted to the casing via the downstream supporting structure 160. The downstream inner partition wall 120 is fixed by inserting the bolts 162 into the bolt holes 162*a* formed on the casing fixing plate 163 and the base plate 161, and screwing the bolts 162 to the female screws provided on the casing fixing plate 163. When mounting, it is desirable to insert the adjusting plate 164 having an appropriate thickness between the casing fixing plate 163 and the base plate 161 to adjust the inner circumferential surfaces on the exhaust chamber side of the upstream inner partition wall 110 and the downstream inner partition wall 120 to be flush. After completing attachment of the downstream inner partition wall 120, the upper-half casing 10A and the lower-half casing 10B are coupled, and the flanges 10A1, 10B are fastened to each other with flange fastening bolts, thereby completing the assembling of the casing 10. Dismantlement of the casing may be carried out in the opposite order of the assembling.

When replacing the inner partition wall 100, it is possible to easily remove the upstream inner partition wall 110 in the axial direction by removing the downstream inner partition wall 120 at the downstream side. While it is necessary to remove the whole inner partition wall at once in the first embodiment, the inner partition wall can be removed separately in the present embodiment, which facilitates the replacement work. Further, in maintenance, the upstream inner partition wall 110 alone needs to be replaced. Thus, the present embodiment is more cost effective than the first embodiment.

The first and second embodiments of the present invention were described in detail above, but the present invention is not limited thereto, and various amendments and modifications may be implemented within a scope that does not depart from the present invention. While the above embodiments can be suitably employed in a low-pressure casing where a drain is likely to accumulate, they may be employed in other casings.

In the above embodiment, the inner partition wall 30, 100 is supported via the upstream supporting structure 40A, 40B, 140 and the downstream supporting structure 50A, 50B, 160. However, three or more supporting structures may be provided in the turbine axial direction L, and the number and position of the supporting structures are not limited to the above configurations.

Further, in the above embodiment, the described example includes a supporting structure in which the inner partition wall 30, 100 is supported on the casing 10 by the supporting structure 40, 50, 140, 160. However, the inner partition wall 30, 100 may be supported on the casing 10 by a supporting structure having another configuration.

Figure 14:
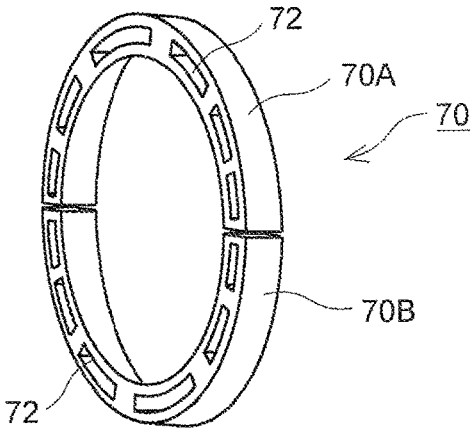
FIG. 14 is a perspective view of a ring member according to the first and second embodiments.

For instance, the inner partition wall 30, 100 may be supported on the casing 10 by a ring member 70 illustrated in FIG. 14. FIG. 14 here is a perspective view illustrating the ring member 70. The configuration of components other than the ring member 70 will be described using the same reference signs as those described above. The ring member 70 includes an upper-half ring member 70A and a lower-half ring member 70B which are both attached to the casing 10 side to protrude toward the inner circumferential side from the casing 10. A plurality of openings 72 that communicate in the turbine axial direction L are disposed on the ring member 70 in the circumferential direction. The inner partition wall 30, 100 is supported with respect to the casing 10 at the entire periphery in the circumferential direction via the above ring member 70. Thus, it is possible to fix the inner partition wall 30, 100 to the casing 10 even more stably.

REFERENCE SIGNS LIST

1 Axial-flow exhaust turbine
2 Rotor
3 Disc
4 Blade cascade
6 Steam passage
8 Exhaust chamber
10 Casing
10A Upper-half casing
10B Lower-half casing
12 Rotor blade
12*a* Final-stage rotor blade
14 Stator blade
14*a* Final-stage stator blade
30 Inner partition wall
30A Upper-half partition wall
30B Lower-half partition wall
31 Horizontal dividing plane
32 Rib
34 Drain flow channel
36, 38 Clearance
40A, 40B, 140 Upstream supporting structure (first structure)
50A, 50B, 160 Downstream supporting structure (second structure)
41, 51 Supporting rod
42A, 42B, 52A, 52B Casing-side supporting member
43A Fitting groove
44A, 54A First key slot (upstream first key slot, downstream first key slot)
44B, 54B Second key slot (upstream second key slot, downstream second key slot)
45A, 45B, 55A, 55B, 142 Partition-wall-side supporting member
46A, 56A Protruding portion
48A, 58A First key (upstream first key, downstream first key)
48B, 58B Second key (upstream second key, downstream second key)
49A, 59A, 49B, 59B, 143, 162 Bolt
70 Ring member
70A, 70B Half ring member (upper-half ring member, lower-half ring member)
72 Opening
100 Inner partition wall
101 Inner casing
102 Supporting rod
110 Upstream inner partition wall
111 Guide portion
112 Support portion
113 Through hole
120 Downstream inner partition wall
121 Reinforcement plate
141 Supporting rod
142*a* Tip end hole
150 Positioning member for partition wall
151 Bush
151*a* Pin hole
151*b* Adjustment hole
152 Eccentric pin
153 Body portion
154 Tip end portion
155 Holding portion
161 Base plate
162*a* Bolt hole
163 Casing fixing plate
164 Adjustment plate
165 Reinforcement rib
P1 Center of tip end portion
P2 Center of body portion
P3 Center of bush

The invention claimed is:

1. An axial-flow exhaust turbine comprising, a steam passage in which rotor blades and stator blades are positioned in rows;

an exhaust chamber for discharging steam from the steam passage in a turbine axial direction, the exhaust chamber being positioned at a downstream side of the steam passage;

a casing including a first casing which defines the steam passage and a second casing which defines the exhaust chamber;

an inner partition wall positioned on an inner circumferential side of the second casing so as to face the exhaust chamber; and a drain flow channel which is defined between the second casing and the inner partition wall, the drain flow channel being in communication with the steam passage, wherein the inner partition wall is supported on the second casing so as to be attachable and detachable, wherein the casing is dividable at a horizontal dividing plane so as to include an upper-half casing and a lower-half casing, wherein the inner partition wall is dividable at the horizontal dividing plane so as to include an upper-half partition wall and a lower-half partition wall, and wherein a first key and a second key are fitted into a first key slot and a second key slot at the horizontal dividing plane, respectively, the first key slot being defined over a member on an upper-half casing side and the upper-half partition wall and the second key slot being defined over a member on a lower-half casing side and the lower-half partition wall.

2. The axial-flow exhaust turbine according to claim 1, wherein the first key is fastened to the member on the upper-half casing side such that the first key supports a load of the upper-half partition wall.

3. The axial-flow exhaust turbine according to claim 1, wherein the first key slot includes an upstream first key slot and a downstream first key slot, the upstream first key slot being positioned over the upper-half partition wall and the member on the upper-half casing side at an upstream side, the downstream first key slot being positioned over the upper-half partition wall and the member on the upper-half casing side at a downstream side, and the first key including an upstream first key and a downstream first key fitted into the upstream first key slot and the downstream first key slot, respectively, and wherein the second key slot includes an upstream second key slot and a downstream second key slot, the upstream second key slot being positioned over the lower-half partition wall and the member on the lower-half casing side at an upstream side, the downstream second key slot being positioned over the lower-half partition wall and the member on the lower-half casing side at a downstream side, and the second key including an upstream second key and a downstream second key fitted into the upstream second key slot and the downstream second key slot, respectively.

* * * * *